United States Patent [19]

Strom et al.

[11] 4,065,845

[45] Jan. 3, 1978

[54] DEVICE FOR CHANGING BORE CROWNS

[75] Inventors: Rolf Strom; Veikko Heikkila; Leo Hakkinen, all of Tampere, Finland

[73] Assignee: Oy Tampella AB, Finland

[21] Appl. No.: 569,985

[22] Filed: Apr. 21, 1975

[30] Foreign Application Priority Data

Apr. 23, 1974 Finland ..... 741219

[51] Int. Cl.[2] ..... B23Q 3/157; E21C 19/04

[52] U.S. Cl. ..... 29/283; 29/26 A; 29/240; 175/85; 211/1.5; 408/35; 175/52

[58] Field of Search ..... 175/52, 85; 29/211 R, 29/568, 26 A, 283, 240; 408/35; 74/813 L; 81/57.37, 57.5; 211/1.5, 60 T, 69

[56] References Cited

U.S. PATENT DOCUMENTS

| | | | |
|---|---|---|---|
| Re. 25,670 | 10/1964 | Hansen et al. | 408/35 X |
| Re. 25,812 | 6/1965 | Morgan | 29/568 |
| 3,976,149 | 8/1976 | Granholm et al. | 175/52 |

*Primary Examiner*—Othell M. Simpson
*Assistant Examiner*—Z. R. Bilinsky
*Attorney, Agent, or Firm*—Gifford, Chandler, Sheridan & Sprinkle

[57] ABSTRACT

A device for changing bore crowns on a drill rod including a bore crown magazine member and means for automatically stopping and locking the magazine member in a desired rotated position.

2 Claims, 4 Drawing Figures

DEVICE FOR CHANGING BORE CROWNS

BACKGROUND OF THE INVENTION

I. Field of the Invention

The present invention relates to mining equipment and more particularly to a device for changing bore crowns on a drill rod.

II. Description of the Prior Art

In short hole drilling, which is carried out with the aid of a single or multiple jib drilling jumbo rig, the present inconvenience is that the drill operator is repeatedly compelled to move away from the control center to replace dulled drill rods. At present, as the drilling is mostly with but few exceptions done with fixed rods, the rod has to be changed on the average after every fourth drilled hole. In order to complete a whole blasting front e.g. with a three-jib jumbo, the rod has to be changed from 15 to 20 times during a period of about 2 hours, that is approximately every six minutes. Such manual drill rod replacement has several drawbacks. On the one hand it slows down the drilling operation because the other machines may be idle while the operator is away changing a rod and on the other hand there are considerations of work safety; it is highly dangerous to work close to the rotating rods, particularly if the ground is slippery and uneven and the visibility is poor. The heavy weight of the rods makes this a strenuous manual work phase. The drill operator is furthermore bothered by oil mist and noise. The last-mentioned detriments would be eliminated if the drill operator could stay in the insulated cab. This would require, however, that the drill operator need not leave his shelter when a rod has dulled and that instead the replacement could be effected by a remote control.

SUMMARY OF THE PRESENT INVENTION

All the detriments pointed out above would be eliminated if the change of the drilling tool is carried out fully automatically with the aid of the crown changing device constituting the object of this invention.

In accordance with the present invention, it is necessary to perform the drilling with rods to which a detachable crown can be joined. The crown storing and positioning member is most appropriately a rotating revolver-type drum, which may contain the desired number of such crowns, as the drilling job in hand requires. The crown is positioned on the drilling axis by rotating this drum. It is necessary that the drum can be stopped at the exact right moment for successful attachment to the rod. Under visual and manual control, this work is too cumbersome and unreliable in the conditions prevailing in a mine. For this reason, in the device of the invention, the bore crown magazine member has been arranged to be automatically stopped and locked without any separate command.

For attachment of the drill rod to the crown, it has to be possible to lock the crown firmly and securely in its place, and also accurately in a constant position; it is therefore important that this attachment should cause a minimum of wear so that there might not be any direction errors in the positioning, due to dead motion. In the device of the present invention, the locking is effected by means of a piston in a cylinder, urging the crown against the crown magazine member.

DESCRIPTION OF THE DRAWINGS

In the following the device according to the invention is described in detail with the aid of the attached drawings wherein.

DESCRIPTION OF A PREFERRED EMBODIMENT

Figure 1:
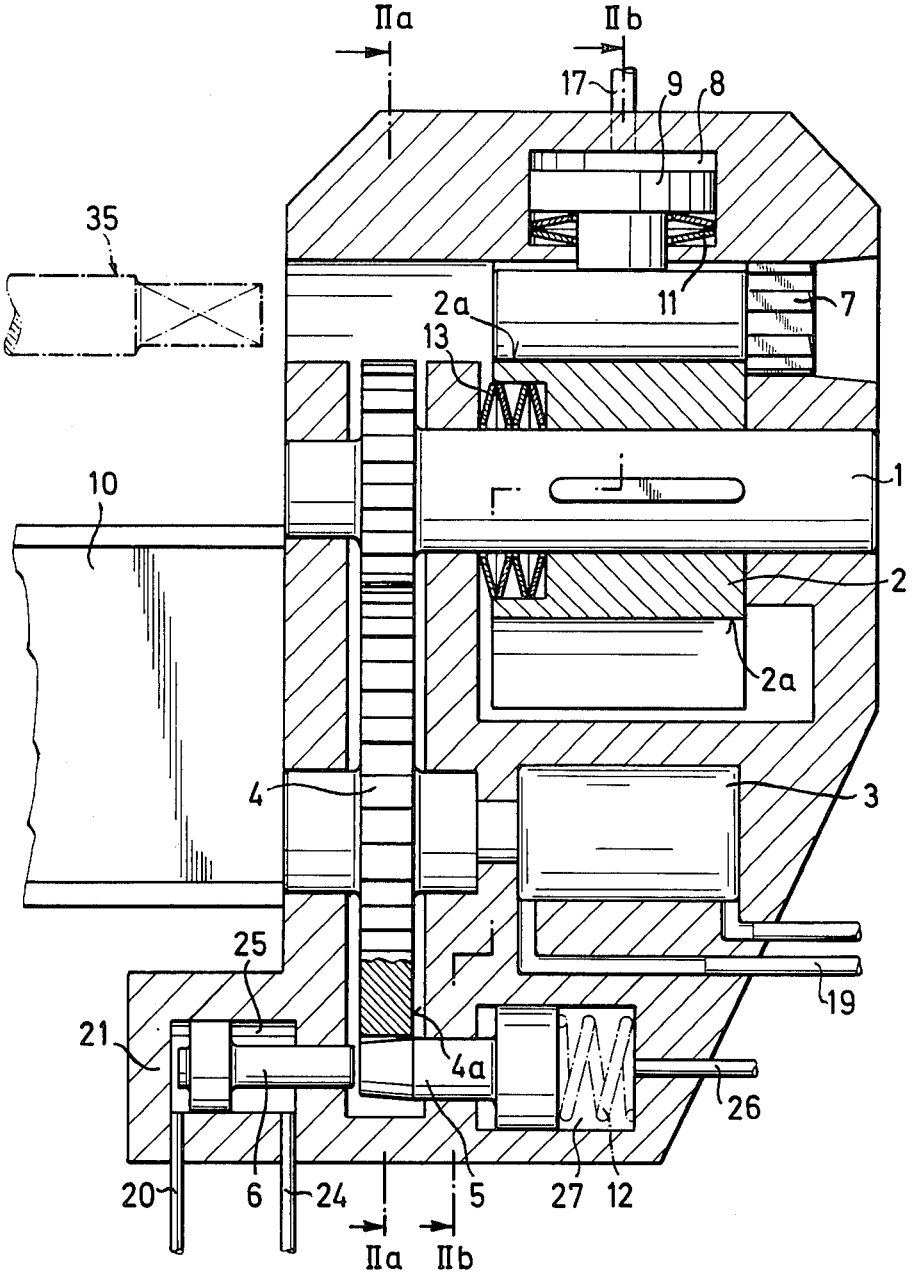
FIG. 1 is an extended cross-sectional view substantially along the line I—I in FIGS. 2*a* and 2*b;*
Figure 2A:
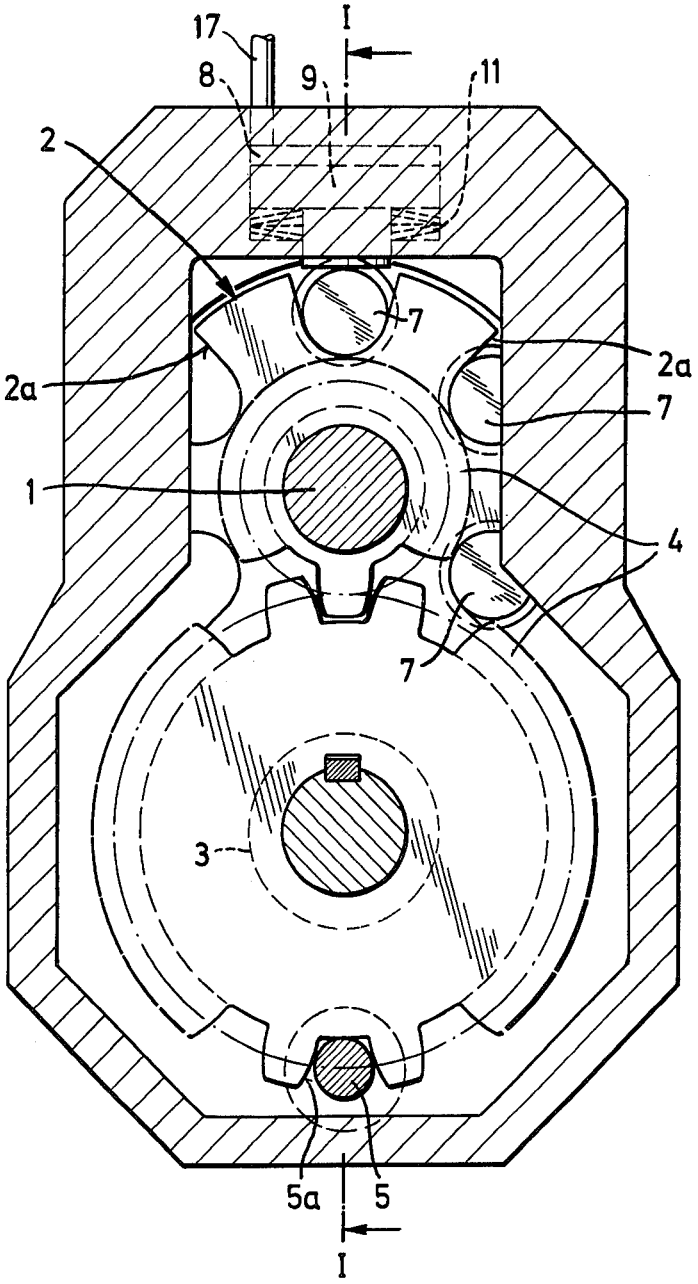
FIG. 2*a* shows the device as sectioned along the line II*a*—II*a* in FIG. 1.
Figure 2B:
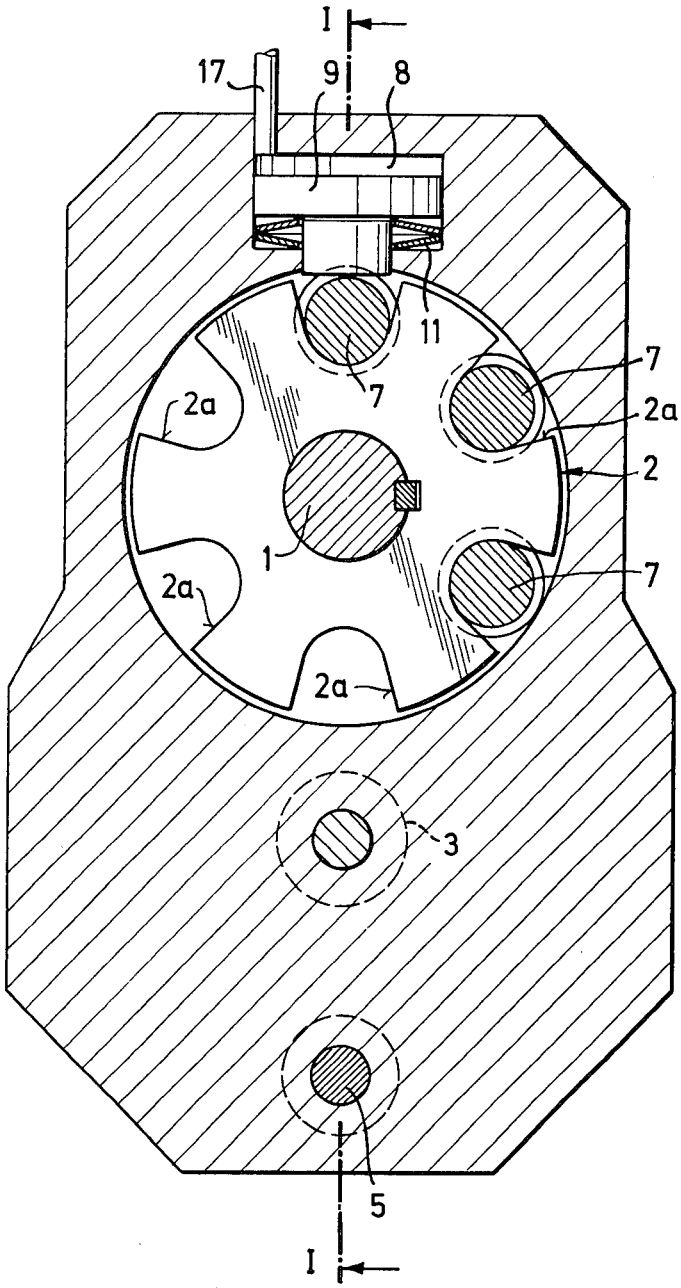
FIG. 2*b* shows the device as sectional along the line II*b*—II*b* in FIG. 1.

As can best be seen in FIGS. 1, 2*a* and 2*b*, the bore crowns are disposed in compartments in a rotatable revolver-like drum 2 carried on an axle 1. The drum 2 may be rotated by means of a pressure fluid-operated motor 3 e.g. through a gear transmission 4. The drum 2 can be locked in any desired position by means of a locking pin 5, which enters e.g. holes or notches in, the gear transmission 4. This locking pin 5 may be caused to leave its hole or notch under pressure control by the aid of a second pin 6, which has a diameter smaller than that of the pin 5. When the pin 5 is driven out of its hole or notch with the pin 6 while the motor 3 strives to rotate constantly, the gear wheel will move a distance equivalent to the difference between the radii of pins 5 and 6. When the pin 6 is again retracted from the hole or notch, the pin 5 is urged against the end face of the gear 4 e.g. by pressure and/or by a spring 12, and it enters the next hole or notch that comes into register, whereby the drum 2 has turned the amount desired.

The crown 7 which is in turn to be attached or detached from the rod 35 can be immovably clamped for the duration of attaching or detaching by urging it against the compartment of the drum 2 with the aid of a piston 9 in cylinder 8, the movements of this piston being effected by means of pressure and/or a spring 11. The crown changing device is most appropriately mounted on the front end of the feed attachment 10 on the jib. The rod 35 is mounted to a feed slide (not shown) to be moved toward and away from the crown changing device as will become more apparent as the description proceeds.

The rotation of the crown magazine member, its stopping in position and locking, and the locking performed by the crown clamping means are the three essential operations in the device constituting the object of the present invention. In order that the operation of the device might not encumber the rest of the construction, it is important that for the accomplishment of these principal operations, pressure fluid need not be conducted to the device by more than one tube and that its return also requires only one tube. The control of the three operations in the device may then be accomplished either by connecting all three in parallel, by connecting them in series, or by connecting two of them in series and the third in parallel with either one of these. One of these alternatives for the control of the changing device can be seen in FIG. 3.

Figure 3:
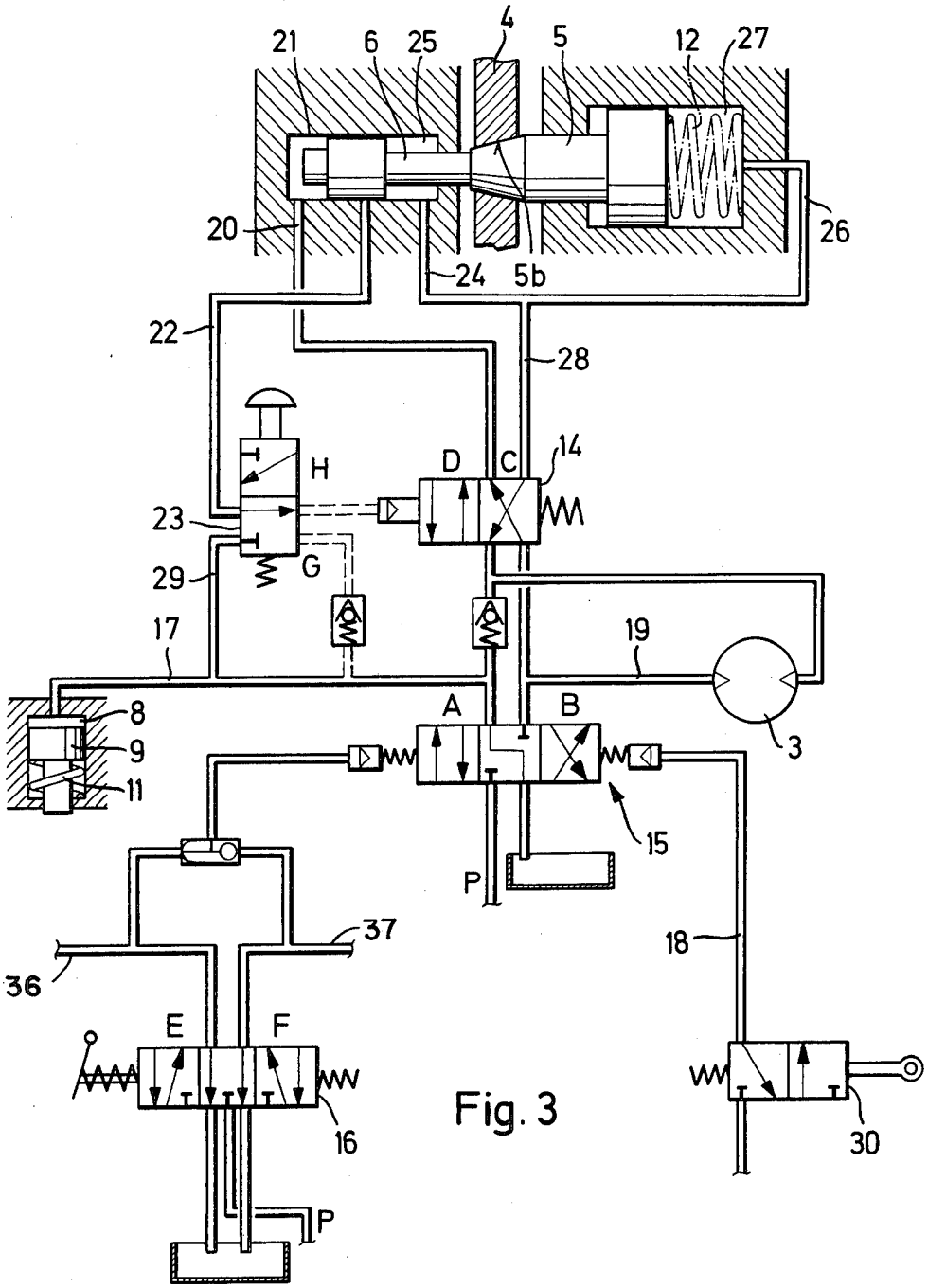
FIG. 3 shows the control circuit diagram of the device.

As can best be seen in FIG. 3, during a drilling operation the valve 15 is in its central position, that is, the pressure side is closed. The valve 15 is a pressure-controlled, spring-centered directional valve, receiving its control pulses as follows. To go into position A, requires a pulse from the manual valve 16, by which also the movement of the feed slide and rotation of the drill rod 35 in both directions are obtained; and the valve 15 goes into position B when the feed slide moves to a retracted position and presses against the limiting valve 30 on the rear plate of the feed attachment 10 (FIG. 1). Lines 36 and 37 from valve 16 connect, respectively, to the hydraulic motor (not shown) for rotating the rod 35 (FIG. 1) and the hydraulic motor (not shown) for moving the rod 35 axially with the feed slide (not shown) along the feed attachment 10 (FIG. 1).

During the drilling operation the valve 14 is in position C, into which it has been urged by a reset spring. The piston 9 in cylinder 8 has been returned from contact with the bore crown by the spring 11. The spring 12 keeps the pin 5 in the hole in the gear 4. When it is desired to change the crown as the used crown has become dull, the valve 16 is manually moved to position E, whereby the valve 15 goes into position A and the piston 9 locks the crown 7 against the drum 2 (FIGS. 1 and 2*b*), the pressure being admitted to cylinder 8 by the tube 17.

The position E of valve 16 also exhausts line 36 initiating the rotation of the drill in the uncoupling direction in a well known fashion and pressurizes line 37 to initiate return motion of the feed slide, until the feed slide begins to bear down on the limiting valve 30. The limiting valve 30 then admits the pressure by the tube 18 to the valve 15, which immediately goes into its center position and changes over to position B as soon as the manual control of valve 16 is released.

The position B of valve 15 has the following effects. The piston 9 comes off the crown 7, pressure is admitted to the motor 3 by tube 19, likewise pressure has access by the tube 20 to the space behind the pin 6, which is thus put under pressure and pushes the pin 5 out of the hole. Owing to the difference in diameters between pins 5 and 6 the gear 4 moves a short distance and is arrested by the pin 6. When the pin 6 has moved the requisite distance, the trailing edge of the piston associated therewith exposes a port in the wall of the cylinder 21, through which the pressure is admitted by tube 22 over valve 23 to the valve 14, changing this valve into position D, whereby the pressure gains access by tube 24 to the cylinder space 25 and pushes the pin 6 from the hole, thus releasing the gear 4 to be free to rotate. The pressure also goes by tube 26 to the cylinder space 27, where the pressure urges the pin 5 against the gear 4, which rotates and into the next hole of which the pin 5 is pushed as this hole comes into register. The drum 2 has then performed a rotation such that the next crown has been placed in correct position, that is in register with the retracted drill rod 35. The operation now stops at this stage unless further commands are given.

Further commands may be given e.g. from a manually controlled valve 23 mounted in the vicinity of the changing device, this valve being spring-returned and normally in position G. When it is desired to charge the drum 2 with crowns or to discharge it, rotation of the drum 2 is most conveniently effected by pushing the valve 23 momentarily into position H, whereby the pressure is released from the control connector of valve 14 by tube 29 and the valve 14 goes from position D in to position C, and the rotating mechanism of drum 2 advances the drum one hole in the manner just described.

In any event, as soon as the drum 2 has been brought into desired position and it is desired to attach the drill rod to the crown 7, this is accomplished as follows. The manual valve 16 is placed in position F, whereby the feed slide begins to move forward and the direction of rotation of the drill is in the sense proper for coupling. As the feed slide is disengaged from the limiting valve 30, the valve 15 changes over from position B to A, whereby the piston 9 in cylinder 8 begins to press the crown 7 against the drum 2, and the valve 14 changes over from position D to C owing to the pressure escaping by tube 28. After the rod 35 has been screwed fast to the crown 7, the valve 16 may be released to go into its center position, whereby valve 15 is returned by its reset spring into its center position and the pressure is released from the cylinder 8 of piston 9, with the consequence that the spring 11 disengages the piston 9 from the crown 7. Subsequently, the normal drilling operation may commence.

As will be understood from the foregoing, rotation of the drum 2 is prevented while the rod 35 is attached to a crown so that the drum 2 may only rotate when the feed slide is against the limiting valve 30, and in this situation the rod 35 is spaced from the crown 7.

The device described here has the advantage over designs known in prior art, among others, that it has a fairly small number of components and the construction of the crown magazine member is very sturdy and less subject to wear compared e.g. with an exchangeable cassette. In the device constituting the object of the invention the charging and discharging of the crown magazine member is facilitated by the option of rotating the drum with the aid of the direct control or pre-controlled valve 23, by which the rotating mechanism is controlled in a manner deviating from the normal crown replacement procedure. An appropriate component to fill this purpose is, for instance, a two-position push button-controlled, spring-returned directional valve 23, the actuation of which causes the crown magazine member 2 to rotate the distance equivalent to one compartment.

The purpose of the spring 13 (FIG. 1) is to lock the drum 2 serving as crown magazine member to be immovable during drilling operations and transports, in order to eliminate movements and wear between the rotating means. The same would be accomplished by applying pressure instead of a spring.

Having thus described our invention we claim:

1. A device for changing bore crowns on a drill rod having means for coaxial attachment with said bore crown upon rotation of said drill rod relative to said bore crown in one rotational direction and for detachment from said bore crown upon rotation in the other direction, said device comprising a rotatably mounted bore crown magazine member, said magazine member having a plurality of circumferentially spaced axial bores formed therethrough wherein each of said axial bores is adapted to carry one of said bore crowns therein, means for rotationally positioning said magazine member so that one of said axial bores in said magazine member is coaxial with the axis of a drill rod, means for urging said bore crown against said magazine member to thereby prevent rotation of said bore crown during attachment to or detachment from a drill rod said means for rotationally positioning said magazine includes gear transmission means including at least one gear means for rotating said magazine member, a plurality of notches provided on said at least one gear and in which said rotational positioning means further comprises a first pin and second pin, said pins being axially aligned and having different diameters and means selectively moving said pins into and out of said notches to thereby rotationally position said magazine member in rotational increments equal to one-half the difference in diameter between said pins.

2. A device for changing bore crowns on a drill rod having means for coaxial attachment with said bore crown upon rotation of a drill rod relative to said bore crown in one rotational direction and for detachment from said bore crown upon rotation in the other direction, said device comprising a rotatably mounted bore crown magazine, said magazine having a plurality of circumferentially spaced axial bores formed therethrough wherein each of said axial bores is adapted to carry one of said bore crowns therein, and means for rotationally positioning said magazine so that one of said axial bores in said magazine is coaxial with the axis of a drill rod said means for rotationally positioning said magazine comprising gear transmission means including at least one gear means for rotating said magazine member, and a plurality of notches provided on said at least one gear and said rotational positioning means further comprising a first pin and second pin, said pins being axially aligned and having different diameters and means selectively moving said pins into and out of said notches to thereby rotationally position said magazine in rotational increments equal to one-half the difference in diameter between said pins.

* * * * *